US012448750B2

(12) United States Patent
Uribe et al.

(10) Patent No.: US 12,448,750 B2
(45) Date of Patent: Oct. 21, 2025

(54) METHOD FOR PRODUCING A RETAINING WALL

(71) Applicant: SOLETANCHE FREYSSINET, Rueil Malmaison (FR)

(72) Inventors: Juan Fernando Uribe, Rueil Malmaison (FR); Robert Rocha, Rueil Malmaison (FR); Juan Carlos Alba, Rueil Malmaison (FR); César Amaya, Rueil Malmaison (FR)

( * ) Notice: Subject to any disclaimer, the term of this patent is extended or adjusted under 35 U.S.C. 154(b) by 168 days.

(21) Appl. No.: 18/268,248

(22) PCT Filed: Dec. 13, 2021

(86) PCT No.: PCT/EP2021/085369
§ 371 (c)(1),
(2) Date: Jun. 19, 2023

(87) PCT Pub. No.: WO2022/144162
PCT Pub. Date: Jul. 7, 2022

(65) Prior Publication Data

US 2024/0052589 A1 Feb. 15, 2024

(30) Foreign Application Priority Data

Dec. 30, 2020 (FR) ..... 2014273

(51) Int. Cl.
*E02D 29/02* (2006.01)
*E02D 17/00* (2006.01)
*E02D 17/20* (2006.01)

(52) U.S. Cl.
CPC ..... *E02D 17/207* (2013.01); *E02D 29/0266* (2013.01)

(58) Field of Classification Search
CPC .... E02D 5/04; E02D 5/06; E02D 5/08; E02D 17/207
See application file for complete search history.

(56) References Cited

U.S. PATENT DOCUMENTS 2,073,545 A * 3/1937 Atkinson ..... E02D 19/04 405/278
2,128,428 A * 8/1938 Murray, Jr. ..... E02D 5/04 405/278

(Continued)

FOREIGN PATENT DOCUMENTS

DE 3615601 C1 8/1987
EP 1813727 A2 8/2007

(Continued)

*Primary Examiner* — Benjamin F Fiorello

(57) ABSTRACT

A method for fabricating a retaining wall configured to extend into a ground comprising the steps of providing at least a first longitudinal support having a receiving part and extending along a first longitudinal direction; placing the first longitudinal support transversely to the ground; providing at least a first module comprising a longitudinal element and a first wing; positioning the first module parallel to the first longitudinal support; connecting the first module to the first longitudinal support, so that the first wing of the first module is slidably engaged with the receiving part of the first longitudinal support; then moving said first module in translation along the first longitudinal direction, and sinking said first module into the ground and then the first longitudinal support into the ground.

21 Claims, 17 Drawing Sheets

(56) References Cited

U.S. PATENT DOCUMENTS

| | | | | | |
|---|---|---|---|---|---|
| 2,275,662 | A * | 3/1942 | Sturdy | E02D 5/16 | 405/278 |
| 3,059,436 | A * | 10/1962 | Hermann, Jr. | E02D 5/04 | 405/278 |
| 4,028,901 | A * | 6/1977 | Barber | E02D 13/02 | 405/277 |
| 4,419,030 | A * | 12/1983 | Burkemper | E02D 19/04 | 405/278 |
| 4,648,752 | A * | 3/1987 | Guy | E02B 17/0021 | 405/277 |
| 4,863,315 | A * | 9/1989 | Wickberg | E02D 5/08 | 405/281 |
| 6,427,402 | B1 * | 8/2002 | White | E02D 19/12 | 405/281 |
| 7,935,406 | B2 * | 5/2011 | Heindl | E02D 5/06 | 405/277 |
| 7,980,789 | B2 * | 7/2011 | Heindl | E02D 5/08 | 405/281 |
| 10,731,312 | B2 * | 8/2020 | Jarvie | E02D 5/54 | |

FOREIGN PATENT DOCUMENTS

| | | | |
|---|---|---|---|
| FR | 479161 | A | 2/1916 |
| FR | 785120 | A | 8/1935 |
| JP | S5113106 | A | 2/1976 |
| JP | S52128608 | A | 10/1977 |
| WO | 2019000031 | A1 | 1/2019 |

* cited by examiner

[Fig. 1]
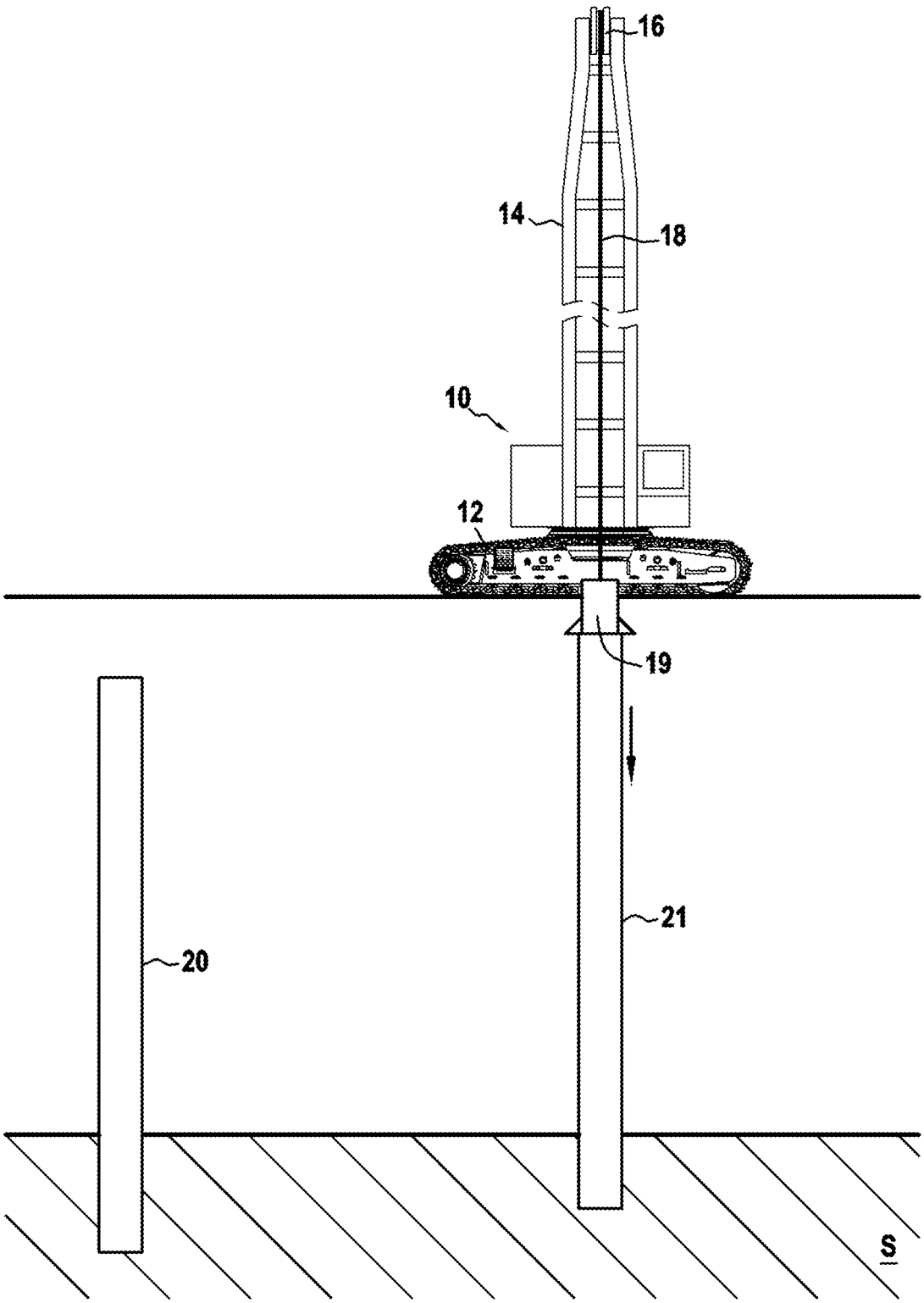

[Fig. 2]
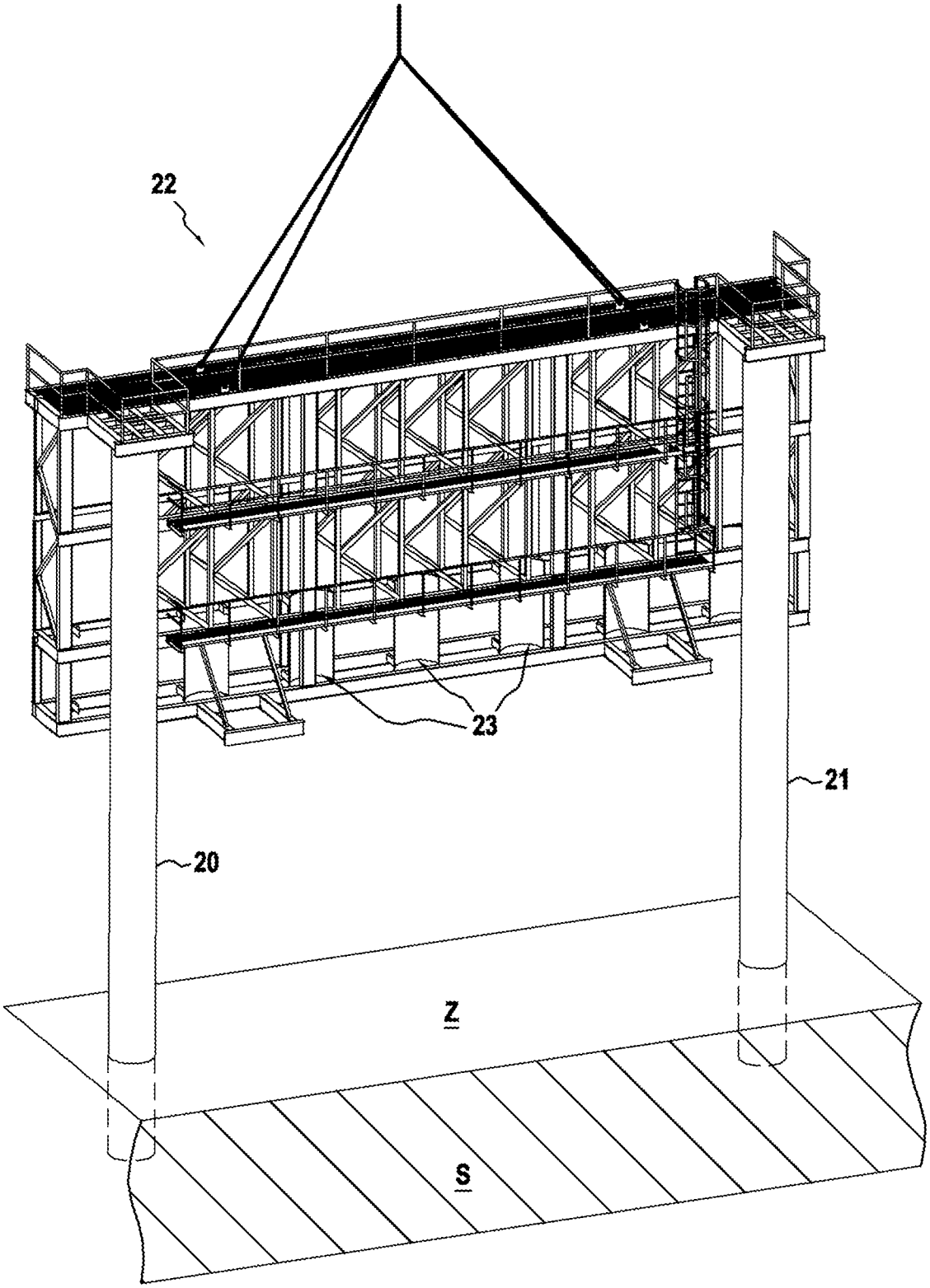

[Fig. 3]
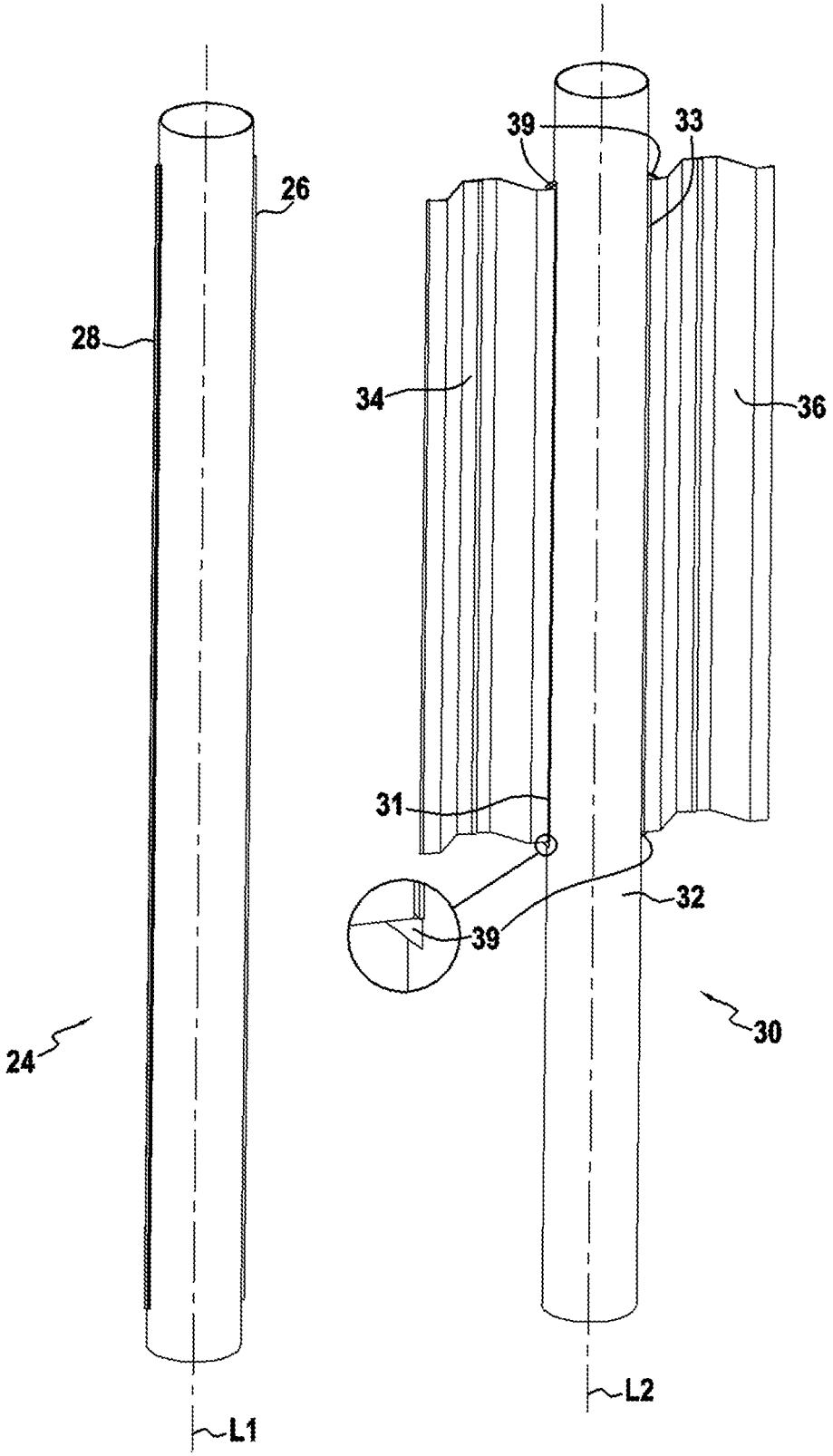

[Fig. 4]
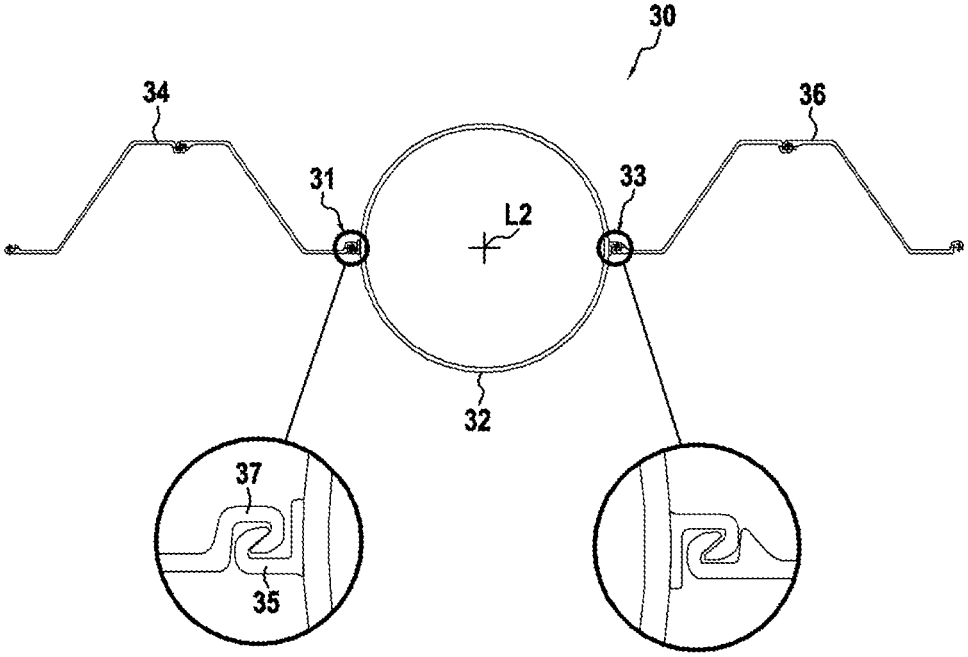

[Fig. 5]
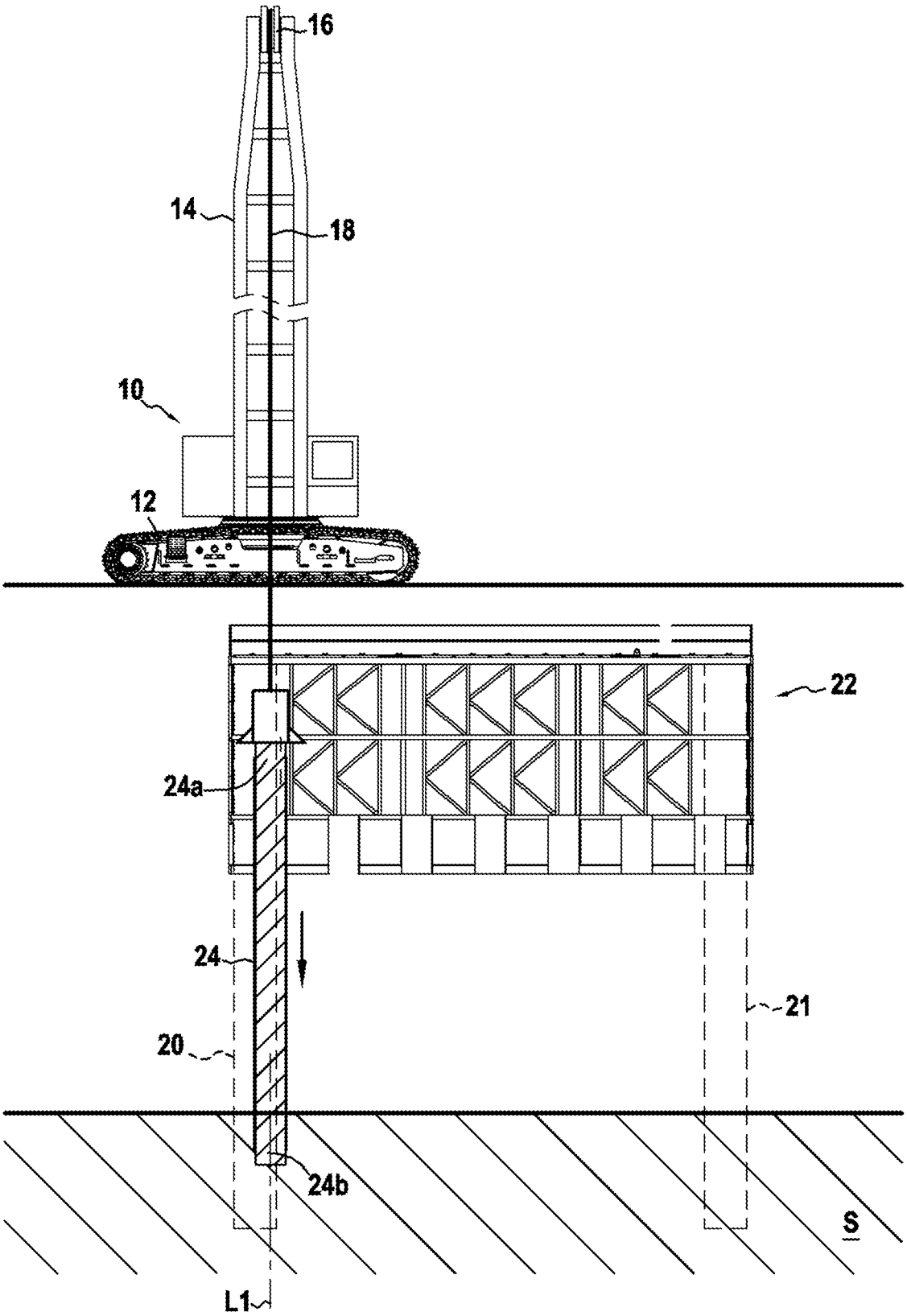

[Fig. 6]
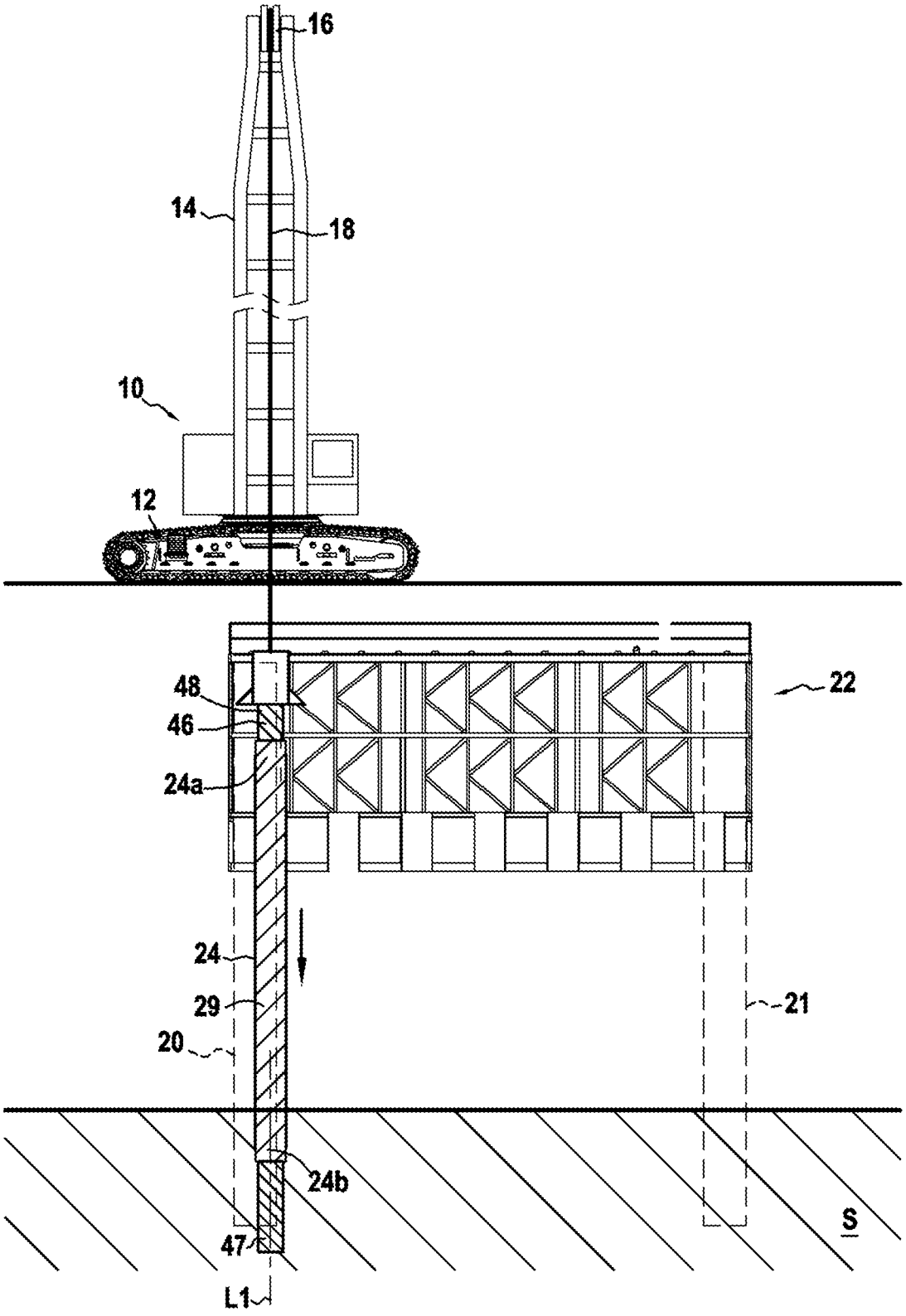

[Fig. 7]
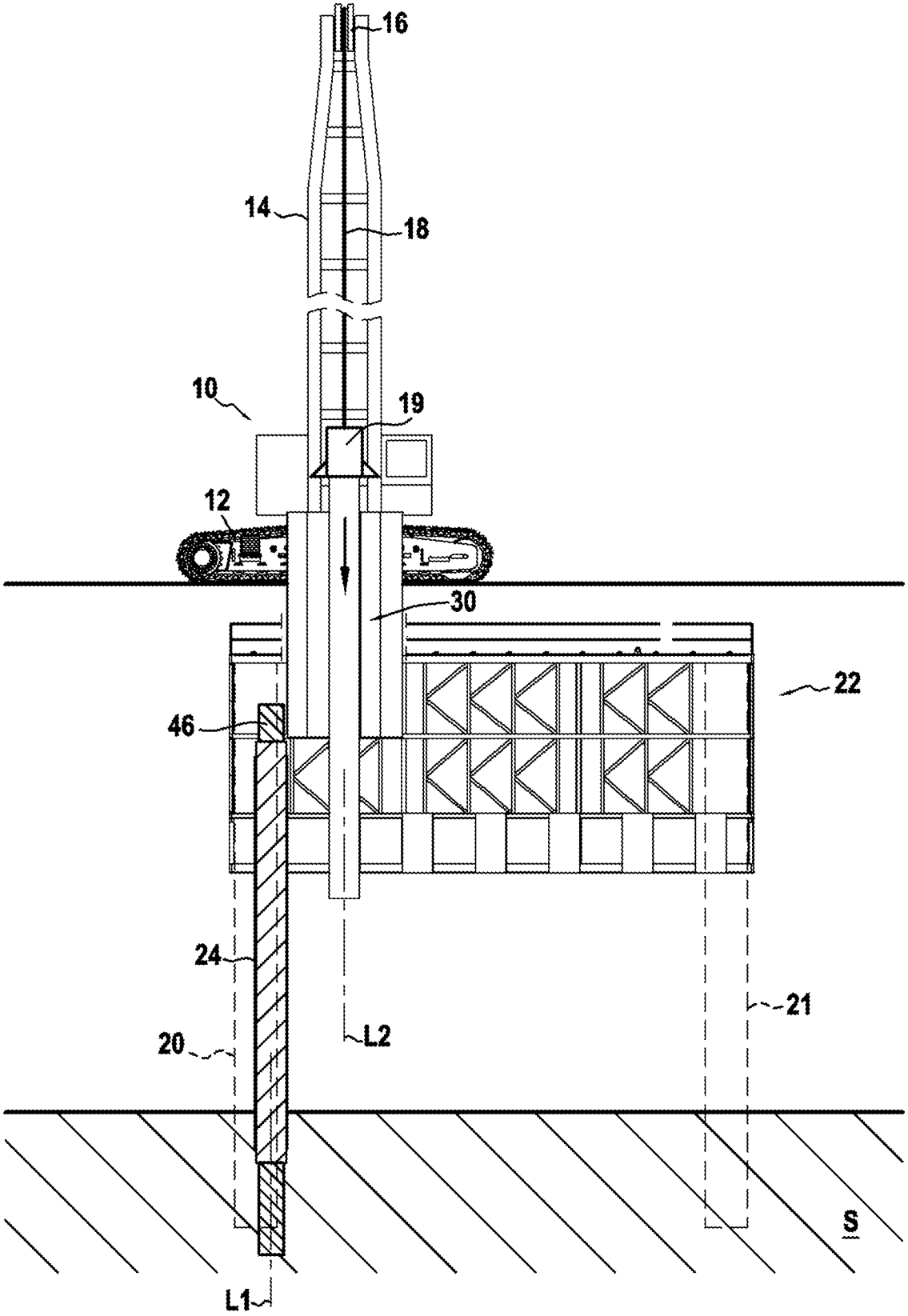

[Fig. 8]
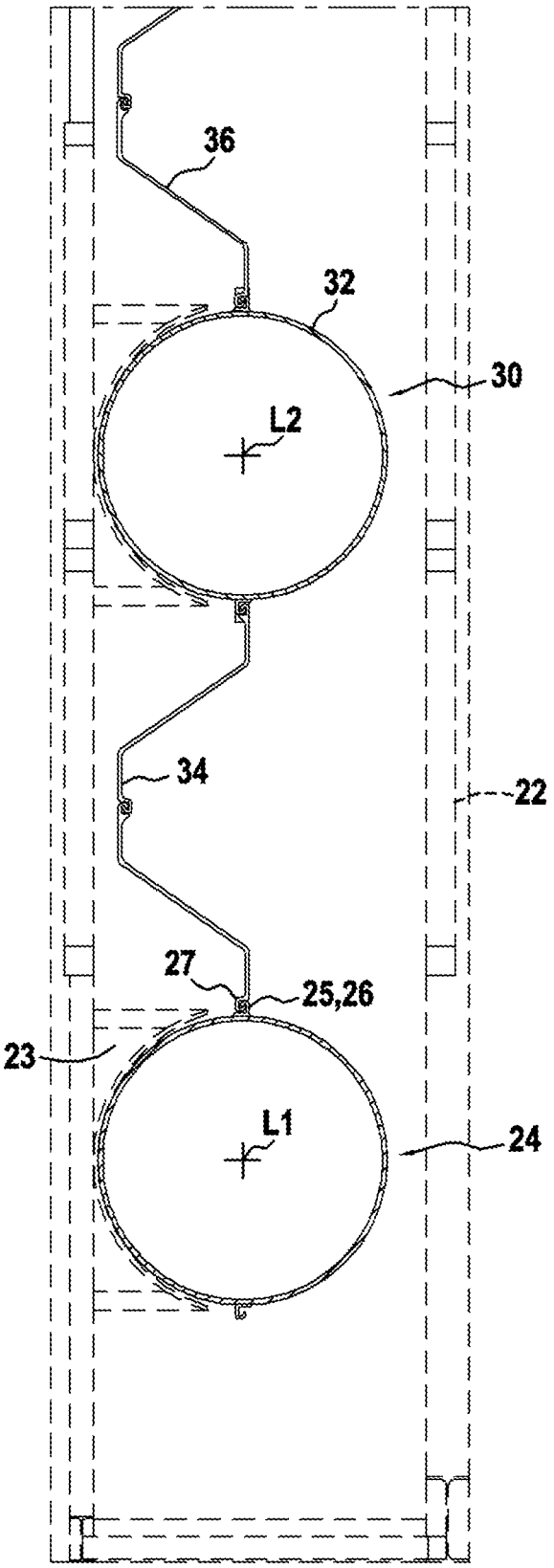

[Fig. 9]
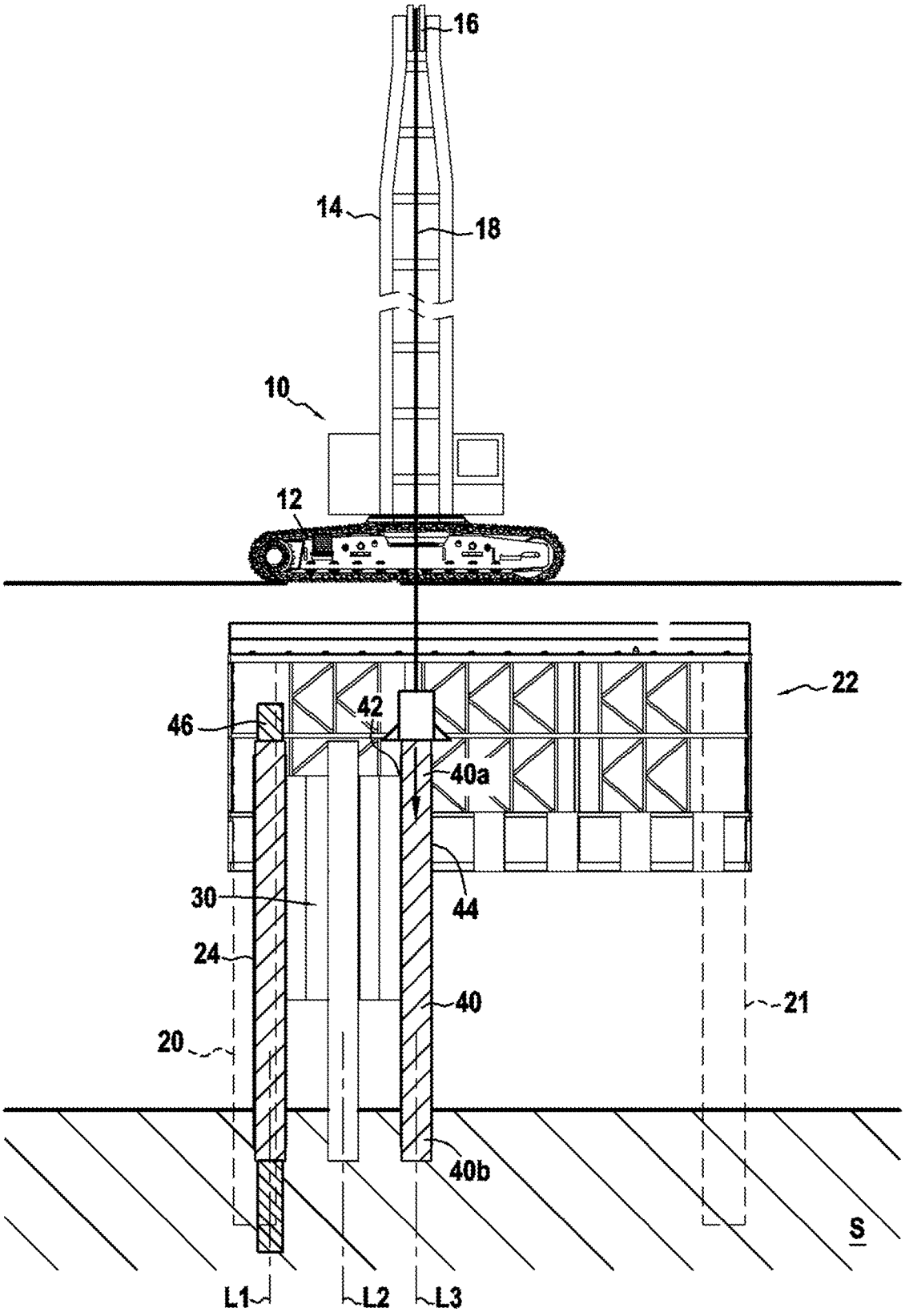

[Fig. 10]
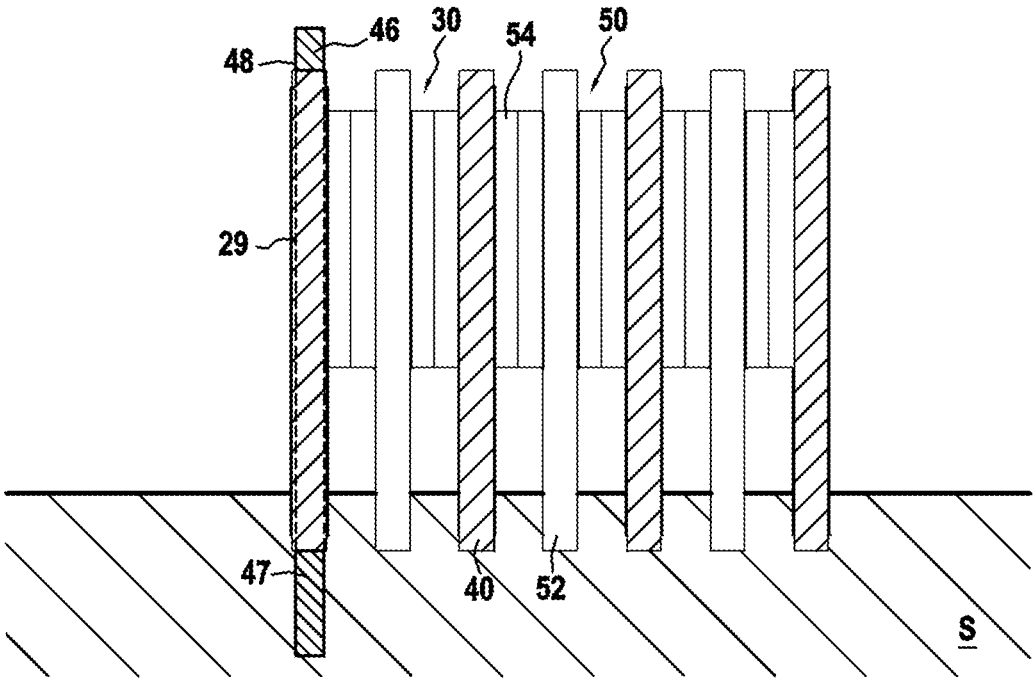

[Fig. 11]
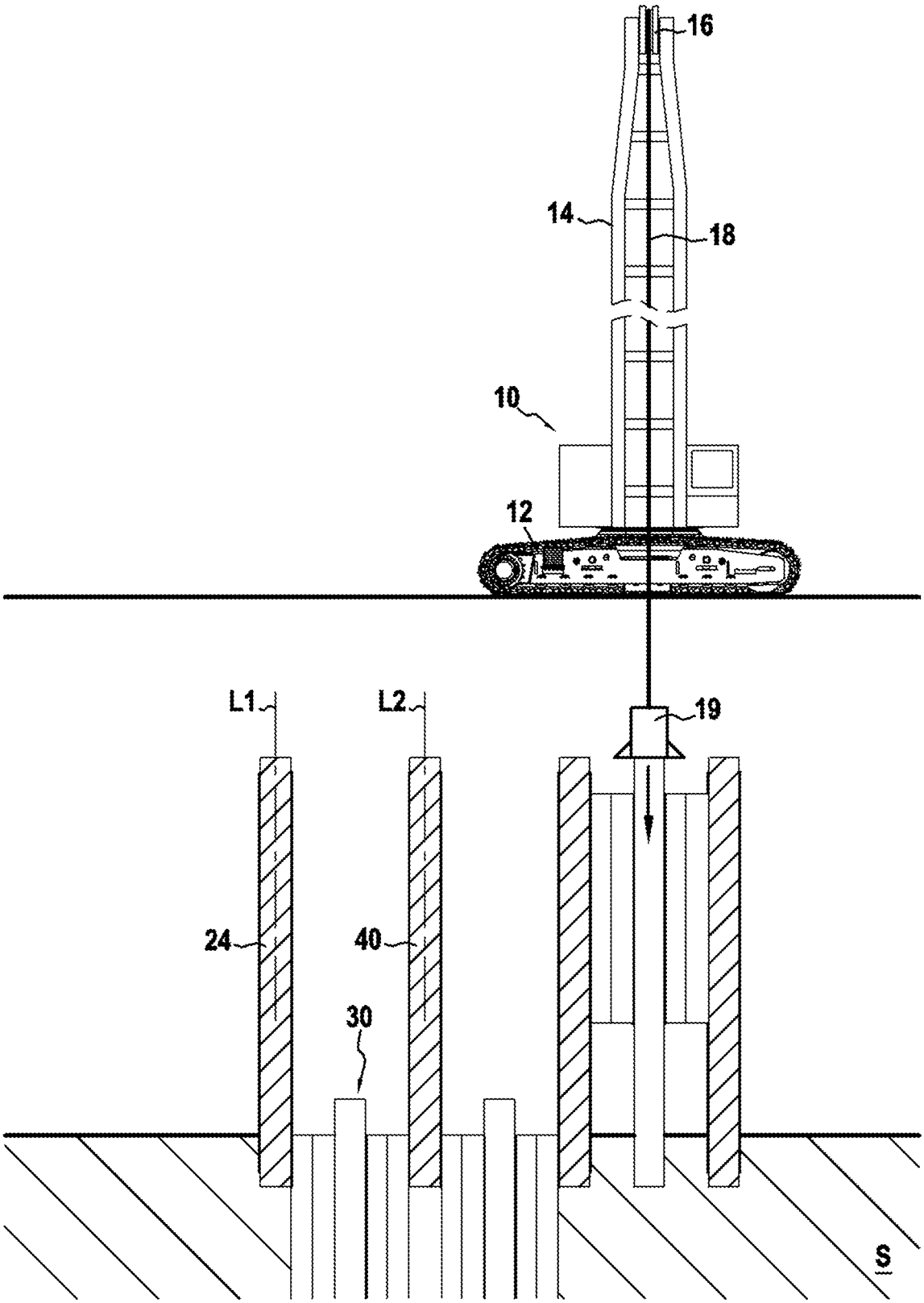

[Fig. 12]
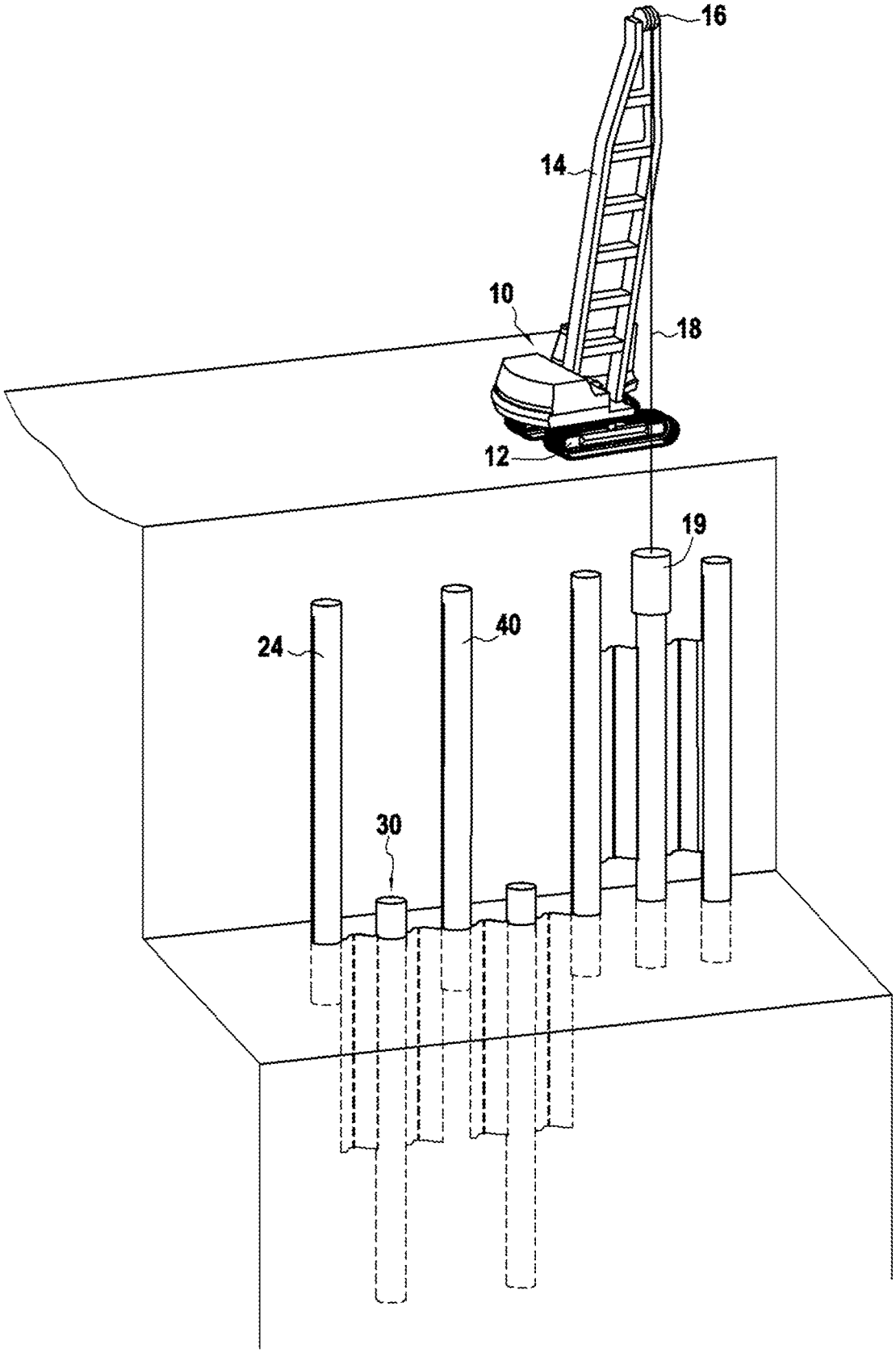

[Fig. 13]
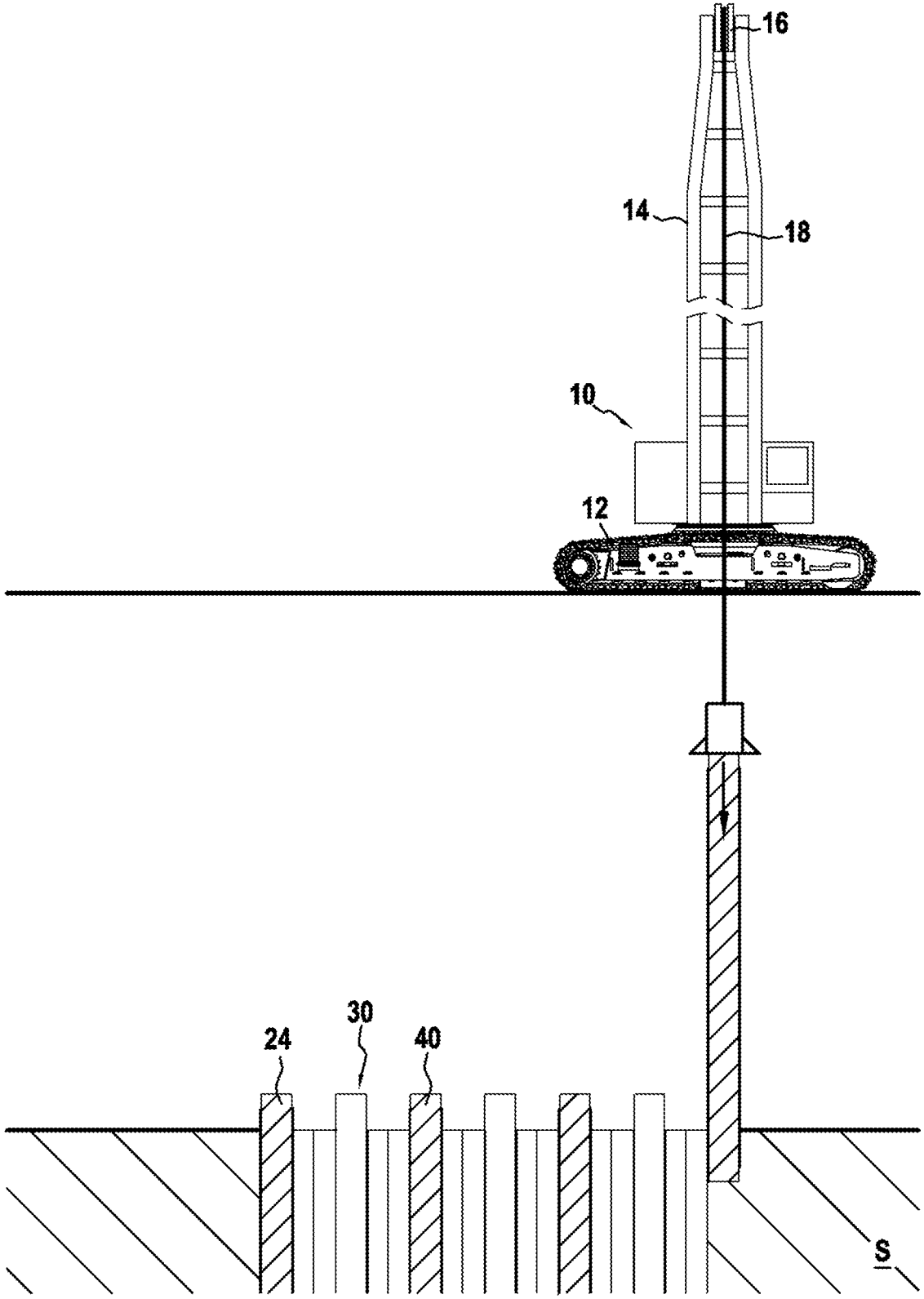

[Fig. 14]
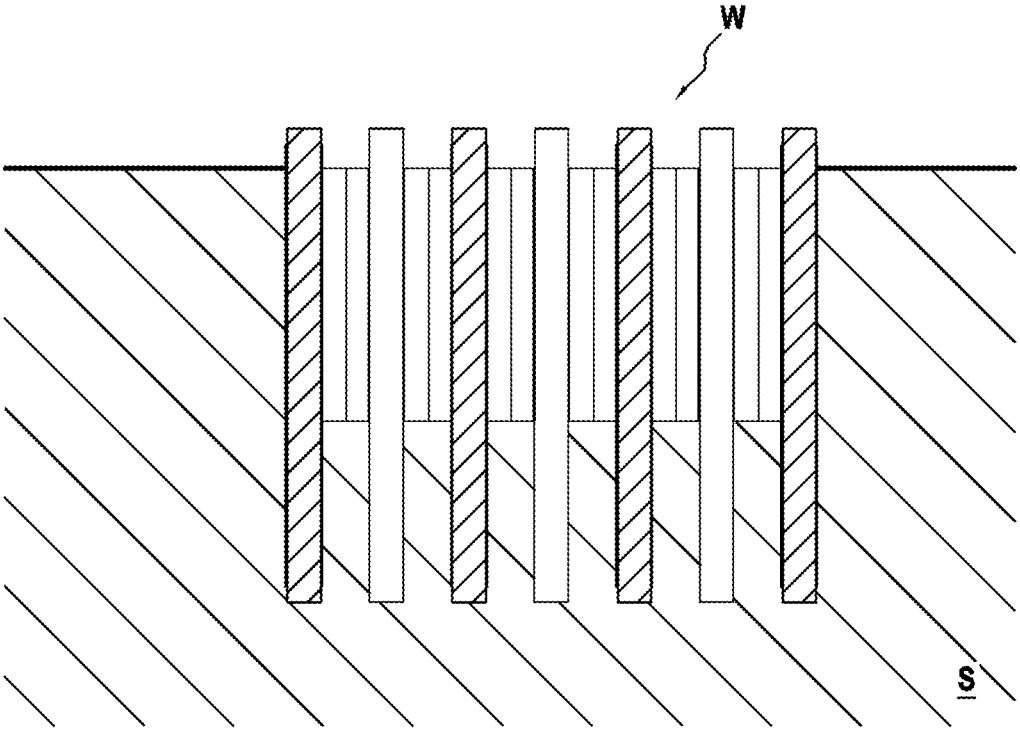

[Fig. 15]
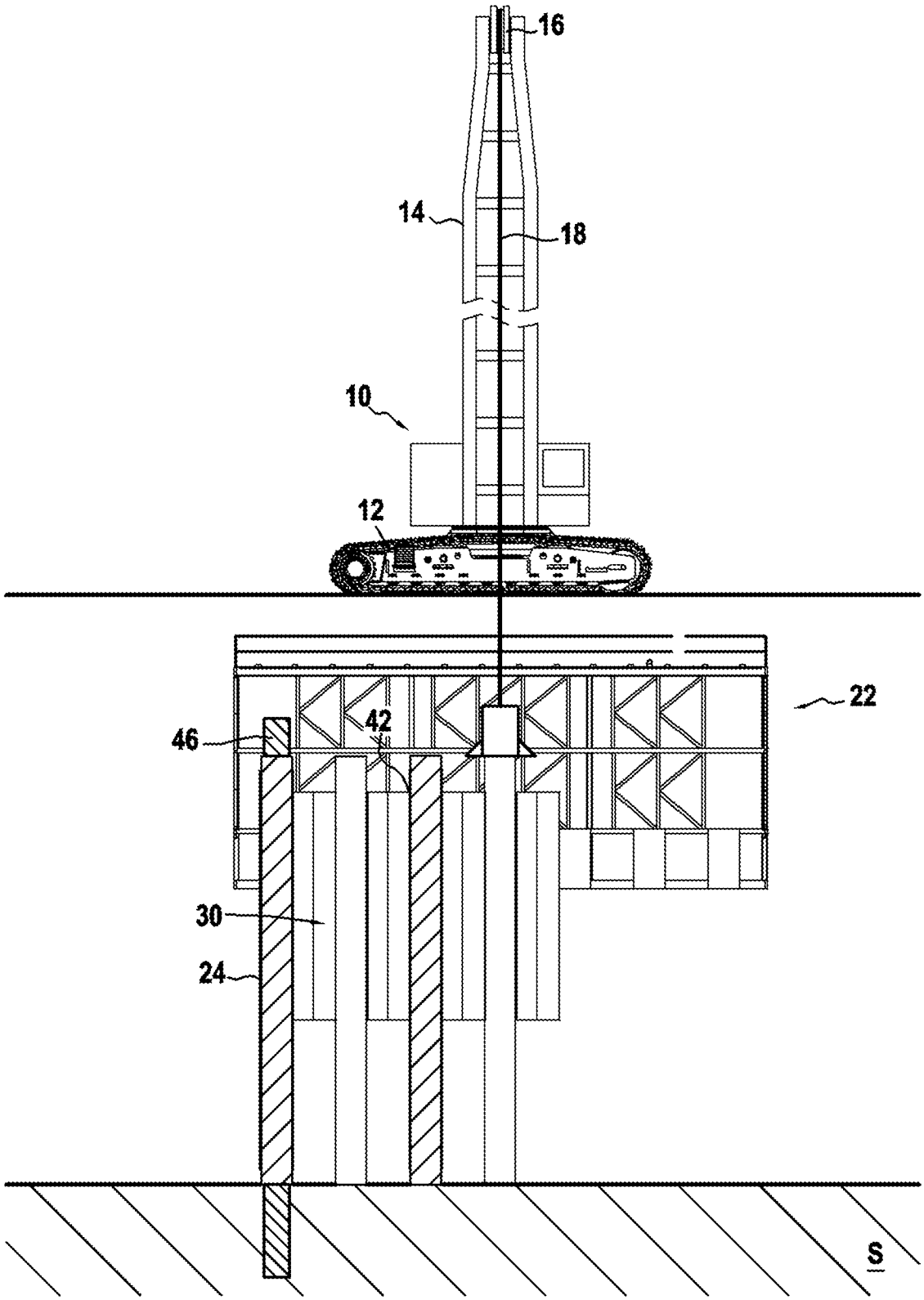

[Fig. 16]
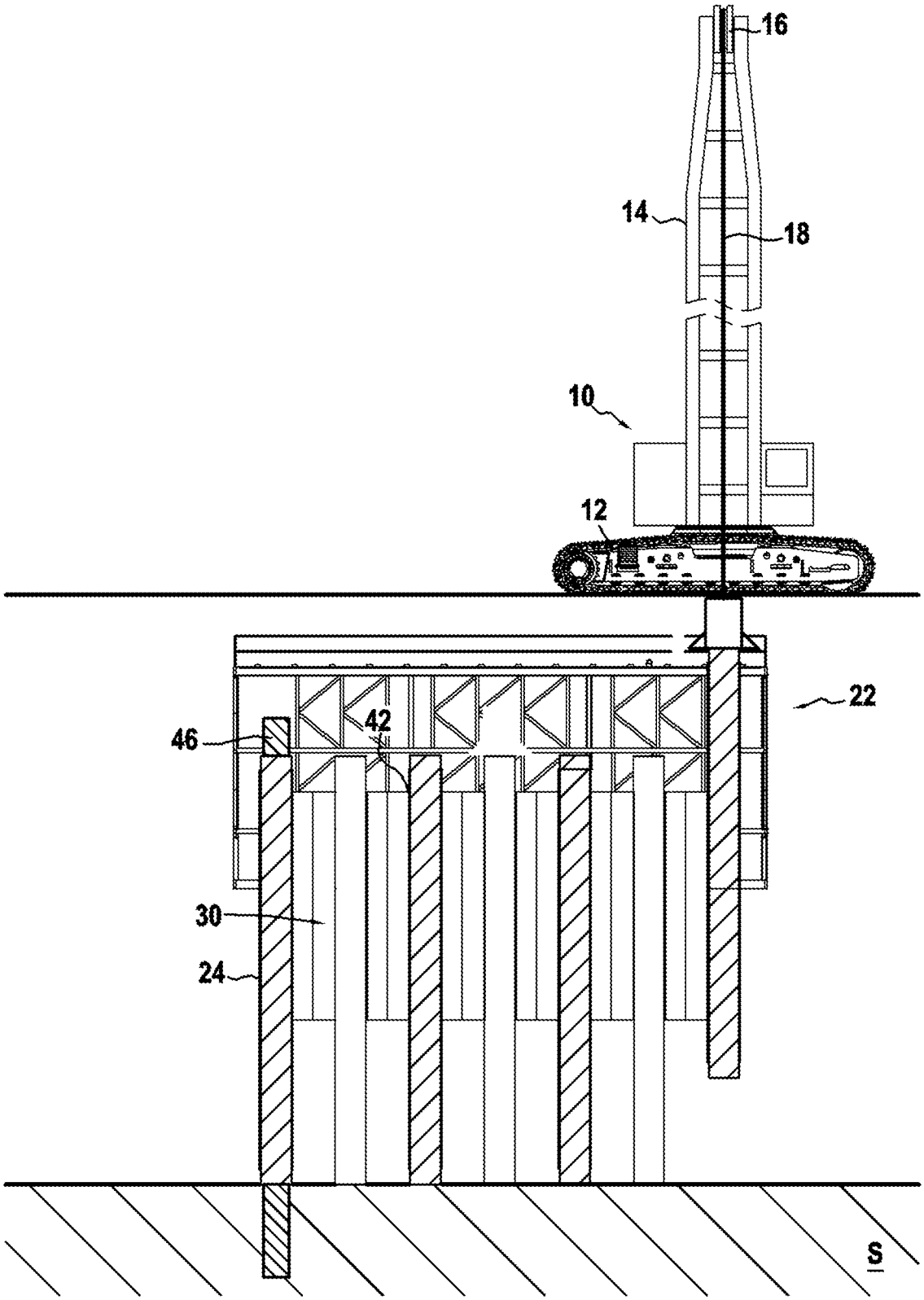

[Fig. 17]
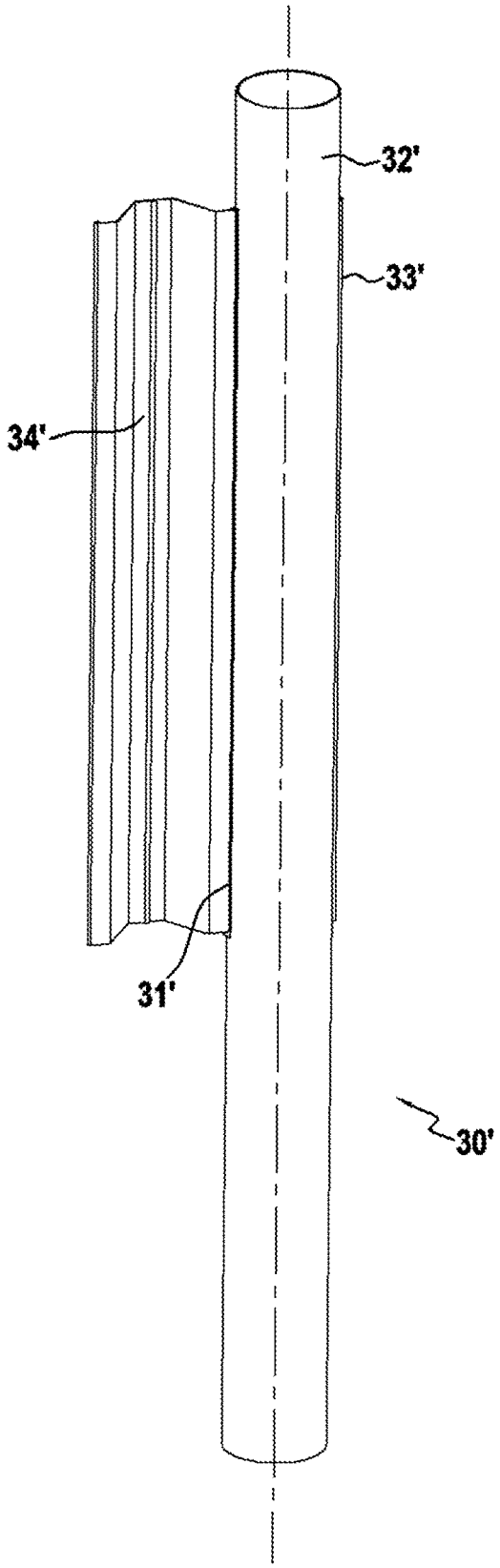

METHOD FOR PRODUCING A RETAINING WALL

TECHNICAL FIELD

The present disclosure relates to the field of the fabrication of retaining walls intended to extend into a ground, making it possible in particular to reinforce such a ground.

The present disclosure relates in particular to the fabrication of retaining walls in port areas, for example quay, lock, bank reinforcement and quay deepening walls.

BACKGROUND

Methods for fabricating a retaining wall in a ground are known, in which a first longitudinal support and a second longitudinal support are fixed to the ground at a distance from each other. A first wing is then connected between these two longitudinal supports, then said wing is moved in translation along said longitudinal supports in order to sink said wing into the ground. A third longitudinal support is then fixed to the ground and a second wing is connected between the second and third longitudinal supports, then moved and sunk into the ground. The successive installation of the longitudinal supports and of the wings is continued, then the longitudinal supports are sunk into the ground so as to obtain a retaining wall formed of a plurality of wings, each being connected between two successive longitudinal supports.

One drawback of this method is that the successive set up of the longitudinal supports and of the wings is particularly long and complicated. Particularly, this method involves carrying out a large number of operations in order to position and sink separately each of the longitudinal elements and each of the wings. Furthermore, insofar as the longitudinal supports are fixed to the ground during the set up of the wings, they provide little freedom in the connection of said wings to said supports. It is in particular necessary to position each of the longitudinal supports very precisely when they are fixed to the ground, in order to be able to connect each of the wings between two adjacent longitudinal supports. A bad positioning of a longitudinal support may compromise the connection of a wing between this longitudinal support and the directly adjacent support(s). Also, when the retaining wall is fabricated in an aquatic basin, it is necessary to regularly involve divers in order to check, under water, the correct positioning and the correct alignment of the longitudinal supports. In some cases, it may even be necessary to extract from the ground an incorrectly positioned longitudinal support and then to position and fix it again, which leads to a loss of time and significant additional costs.

This method is therefore particularly restrictive and does not allow fabricating the retaining wall quickly.

Disclosure of the Disclosure

One aim of the present disclosure is to propose a method for fabricating a retaining wall that overcomes the aforementioned problems.

To do so, the present disclosure relates to a method for fabricating a retaining wall configured to extend into a ground, the method comprising the following steps:

providing at least a first longitudinal support extending along a first longitudinal direction, the first longitudinal support having a receiving part extending along the first longitudinal direction;

placing the first longitudinal support transversely to the ground, so that the first longitudinal support comprises at least a first portion extending out of the ground;

providing at least a first module comprising a longitudinal element extending along a second longitudinal direction and at least a first wing protruding from a first lateral edge of said longitudinal element, the first wing extending along the second longitudinal direction of the longitudinal element;

positioning the first module parallel to the first longitudinal support;

connecting the first module to the first portion of the first longitudinal support, so that the first wing of the first module is slidably engaged along the first longitudinal direction with the receiving part of the first longitudinal support; then moving said first module in translation parallel to the first longitudinal support along the first longitudinal direction, and sinking said first module into the ground; then sinking the first portion of the first longitudinal support into the ground so as to form the retaining wall in the ground.

The retaining wall is fabricated by assembling said at least first longitudinal support and said first module. It is configured to extend at least partly into the ground. The retaining wall is preferably composed of a plurality of longitudinal supports and modules.

The method according to the present disclosure is particularly suitable for the fabrication of retaining walls in port areas, for example quay, lock, bank reinforcement and quay deepening walls. In a non-limiting manner, the ground can be a seabed, for example the bottom of an aquatic basin. The retaining wall advantageously has the form of a curtain.

The first longitudinal support is formed off ground. It is preferably formed in a metal material. In a non-limiting manner, during the set up of the first longitudinal support transversely to the ground, the latter can be partially sunk into the ground, so as to fix it to the ground. As a variant, during its set up, the first longitudinal support can rest on the ground or be maintained above the ground, for example by means of a guide structure. In which case, the first longitudinal support extends entirely out of the ground during its set up.

The first longitudinal direction of the first longitudinal support extends transversely to the ground when said first longitudinal support is set up. Preferably, the first longitudinal support placed transversely to the ground extends substantially vertically. The first longitudinal support advantageously extends substantially perpendicular to the ground, for example if the ground is substantially horizontal.

The receiving part of the first longitudinal support advantageously extends at least partially over the first portion of the first longitudinal support, so that the receiving part extends at least partly out of the ground when the first longitudinal support is placed transversely to the ground. The connection between the first wing of the first module and the first longitudinal support is therefore made off ground and above the ground.

The longitudinal element of the first module advantageously comprises a pile. The first wing of the first module extends radially from the longitudinal element of the first module. Said first wing preferably extends over a length smaller than the length of said longitudinal element. In a non-limiting manner, said first wing can extend over a length smaller than half the length of said longitudinal element. The first wing preferably has the shape of a sheet. The first lateral edge of said longitudinal element extends along the second longitudinal direction. In a non-limiting manner, the longitudinal element of the first module can be similar to the first longitudinal support. For example, the first longitudinal support and the longitudinal element of the first module can be formed of two piles of the same dimensions.

The longitudinal element of the first module acts as a support for the first wing and ensures the recovery of the thrust forces, while the first wing plays the role of shielding and ensures the sealing of the retaining wall.

According to the present disclosure, the wing of the first module cooperates with the longitudinal element of said first module, before positioning the first module parallel to the first longitudinal support and before connecting said first module to the first longitudinal support. In other words, the first module is prefabricated off ground before being set up and before starting the fabrication of the retaining wall.

In a non-limiting manner, during its positioning parallel to the first longitudinal support, the first module can be partly sunk into the ground or be laid on the ground without being sunk therein, or even maintained above the ground. The first module then extends transversely to the ground, preferably vertically. The second longitudinal direction then extends parallel to the first longitudinal direction.

During the step of moving the first module parallel to the first longitudinal support, the first module is moved downwards, towards the ground. The first module is guided in translation along the first longitudinal direction by the first longitudinal support.

Preferably, the first longitudinal support and the first module are moved and sunk into the ground by a driving or sinking technique, by vibration and/or percussion, by means of a crane-type machine equipped with a hammer and/or a vibrator. When the ground is a seabed, an extension tube can be brought into cooperation with the longitudinal element of the first module or with the first longitudinal support, said extension tube being subjected to percussion and/or vibration. One consideration is to avoid diving the hammer and/or the vibrator in water. As a variant, the hammer and/or the vibrator can be placed in a bell allowing its immersion.

When they are sunk into the ground, the first longitudinal support and the first module extend almost entirely into the ground, more preferably entirely into the ground. The step of sinking the first longitudinal support and the first module aims to sink them substantially completely, as opposed to an initiated sinking, or pre-sinking.

Preferably, but in a non-limiting manner, when the retaining wall comprises several longitudinal supports, the first longitudinal support is the last longitudinal support to be sunk into the ground.

Preferably, the retaining wall comprises a plurality of successively fabricated panels. Each of the panels then comprises a plurality of longitudinal supports and modules connected to each other and sunk into the ground according to the steps of the method according to the present disclosure. Each of the panels advantageously comprises a first longitudinal support which is the last longitudinal support of said panel to be sunk into the ground.

According to the present disclosure, the set up of the first module makes it possible to connect to the first longitudinal support, in a single connection operation, at least a wing and a longitudinal element acting as a support for the wing. Unlike the methods of the prior art, it is therefore not necessary to carry out the successive steps of fixing a second support to the ground and then of connecting a wing between such a second support and the first support. The number of operations and the time required to fabricate the retaining wall are therefore reduced.

Furthermore, the methods according to the prior art provide for fixing two longitudinal supports to the ground then simultaneously connecting a wing to the two fixed longitudinal supports, which makes the connection of the wing particularly complicated, or even impossible in the event of poor positioning of said longitudinal supports. Insofar as the method according to the present disclosure does not require simultaneously connecting a wing to two successive longitudinal supports, it makes it possible to overcome the significant constraints of positioning accuracy of the longitudinal supports encountered in the methods according to the prior art and the need to involve divers to ensure the correct positioning of the longitudinal supports. The connection of the wing of the first module to the first longitudinal support is not likely to be compromised by a fault in the positioning of the first module. A faulty positioning of the first module with respect to the first longitudinal support involves at most adjusting the orientation of the first module and of its wing.

Particularly, the position of the first module and of any consecutive modules and longitudinal supports of the retaining wall formed using the method according to the present disclosure mainly depends on the position and orientation of the first longitudinal support. Also, only the first longitudinal support must be correctly positioned and oriented, unlike the methods of the prior art in which each support must be rigorously positioned to allow the connection of the wings, otherwise interventions by divers must be programmed to check and correct the alignment and positioning of the longitudinal supports.

Preferably, the longitudinal element of the first module comprises a first assembly part extending along the first lateral edge of said longitudinal element, and the first wing of the first module comprises a second assembly part configured to cooperate with the first assembly part, the method comprising a prior step of assembling off ground said longitudinal element with said first wing, so that the first assembly part cooperates with the second assembly part. The assembly of the first wing and of the longitudinal element is facilitated insofar as it is carried out off ground, compared to the methods according to the prior art which provide for assembling the wings to fixed supports at least partially sunk into the ground.

Advantageously, the first longitudinal support comprises a pile, a section or a metal box, thanks to which the first longitudinal support is particularly resistant and has a good lifespan. The first longitudinal support is advantageously adapted to be maintained under water. In a non-limiting manner, such a pile, section or box can be of tubular shape, for example of square or circular cross-section, so that its transverse dimensions are much smaller than its length. Such a pile, section or box can be hollow or solid. Such a metal box can be formed by assembling several sheet piles. By section, it is meant an elongated piece of constant cross-section, for example a beam. Such a section differs from a sheet pile in particular in that it has transverse dimensions, considered transversely to its longitudinal direction, which are much smaller than the transverse dimensions of such a sheet pile.

Preferably, but in a non-limiting manner, the longitudinal element of the first module also comprises a pile, a section or a metal box.

Considered along a direction transverse to the second longitudinal direction, the dimensions of the longitudinal element of the first module are preferably smaller than the dimensions of the first wing.

Preferably, said first wing of said first module comprises a sheet pile, whereby the sealing, solidity and lifespan of the retaining wall are improved. Such a sheet pile advantageously has the form of a corrugated metal sheet having a small thickness, preferably comprised between 8 and 20 millimeters.

Advantageously, the first longitudinal support comprises a housing, and before or after having placed the first longitudinal support transversely to the ground, a mast is installed in the ground so that an anchoring portion of the mast extends into the ground, the mast further comprising a supporting portion configured to be disposed in said housing of the first longitudinal support. One consideration is to reinforce and improve the holding in position of the first longitudinal support transversely to the ground, during the fabrication of the retaining wall or even after fabrication. The first longitudinal support is preferably hollow. The mast advantageously has a length greater than that of the first longitudinal support so that it is configured to pass through said first longitudinal support.

In a non-limiting manner, the mast can be installed in the ground before setting up the first longitudinal support, in which case, the first longitudinal support is fitted onto said mast during its set up transversely to the ground.

In a non-limiting manner, the mast can be extracted from the ground and from the housing of the first longitudinal support in order to be removed, for example after having sunk the first longitudinal support into the ground or after the fabrication of the retaining wall.

Advantageously, during the step of setting up the first longitudinal support transversely to the ground, said first longitudinal support is installed in the ground, so that a second portion of the first longitudinal support extends into the ground. The first longitudinal support is then fixed to the ground and pre-sunk. One consideration is to effectively maintain the first longitudinal support transversely to the ground and to prevent it from tilting or pivoting, in particular during the connection with the first module. Preferably, the length of the second portion of the first longitudinal support, extending into the ground, is much smaller than the length of the first portion, extending out of the ground.

Preferably, during the step of positioning the first module parallel to the first longitudinal support, the sinking of the longitudinal element of said first module into the ground is initiated. The longitudinal element is then slightly sunk into the ground or pre-sunk, so as to be fixed to the ground. One consideration is to fix the first module to the ground in order to prevent it from pivoting or moving during the following steps. This makes it possible in particular to maintain the connection between the first module and the first longitudinal support and facilitates the displacement and the sinking of the first module. At the end of this positioning step, the length of the portion of the longitudinal element extending into the ground is advantageously much smaller than the length of the portion of the longitudinal element extending out of the ground.

According to one advantageous variant, during the step of setting up the first longitudinal support transversely to the ground, said first longitudinal support is laid on the ground, so that it extends out of the ground and so that the supporting portion of the mast extends in said housing of the first longitudinal support, and during the step of positioning the first module parallel to the first longitudinal support, said first module is laid on the ground, so that it extends out of the ground. One consideration is to facilitate the connection between the first module and the first longitudinal support insofar as they both extend out of the ground. The first longitudinal support is fitted onto the mast which allows it to be held in position, without it being necessary to fix it to the ground. Insofar as the first longitudinal support is held by the mast, it is also not necessary to fix the first module to the ground during the connection to the first longitudinal support or to allow the connection of another longitudinal support to said first module.

Preferably, the receiving part of the first longitudinal support comprises a first latch portion extending along the first longitudinal direction and said first wing of said first module comprises a second latch portion extending along the second longitudinal direction and being configured to cooperate with the first latch portion in order to engage the first wing of the first module in a sliding manner with said receiving part of the first longitudinal support. The first and second latch portions advantageously have the form of rails provided with a portion forming hooks configured to cooperate with each other, in a detachable manner, while allowing the sliding of the second latch portion with respect to the first latch portion.

According to a first advantageous embodiment, said first module further comprises at least a second wing protruding from a second lateral edge of said longitudinal element, opposite to the first lateral edge, the second wing extending along the second longitudinal direction of the longitudinal element of the first module, so that said first and second wings of said first module extend on either side of said longitudinal element.

Insofar as the first module comprises two wings connected to a longitudinal element, the method according to the present disclosure makes it possible to dispense with the steps of connecting a first wing and a second wing to a support installed in the ground. The number of steps to fabricate the retaining wall is therefore reduced so that the fabrication is facilitated and all the more rapid.

Preferably, the first wing and the second wing extend in the extension of each other.

Advantageously, before moving said first module in translation parallel to the first longitudinal support, the steps are carried out according to which:

- at least a second longitudinal support extending along a third longitudinal direction is provided, the second longitudinal support having a first receiving part extending along the third longitudinal direction;
- the second longitudinal support is placed transversely to the ground, parallel to the first module, so that the second longitudinal support comprises at least a first portion extending out of the ground;
- the first module is connected to the first portion of the second longitudinal support, so that the second wing of the first module is slidably engaged along the third longitudinal direction with the first receiving part of the second longitudinal support.

The first module is then connected between the first longitudinal support and the second longitudinal support and slidably mounted along these two longitudinal supports.

During the set up of the second longitudinal support transversely to the ground, said second longitudinal support can be installed in the ground, or pre-sunk into the ground, so that it comprises a second portion extending into the ground. The length of the second portion is then much smaller than the length of the first portion. As a variant, during this set up, the second longitudinal support can be positioned so as to rest on the ground or so as to extend above the ground, for example supported by a guide structure.

Advantageously, after having connected the first module to the first portion of the second longitudinal support, the sinking of the longitudinal element of said first module into the ground is initiated, then the sinking of said second longitudinal support into the ground is initiated. In other words, the first module and the second longitudinal support are slightly sunk into the ground, or pre-sunk, to a reduced depth. One consideration is to fix them to the ground in order to stabilize them and to prevent them from being moved or pivoted during the following steps, for example during the definitive sinking of the first module or of one of the longitudinal supports into the ground. The length of the portions of the first module and of the second longitudinal support extending into the ground following this sinking initiation step is much smaller than the length of the portions of the first module and of the second longitudinal support extending into the ground following their sinking into the ground.

Preferably, but in a non-limiting manner, during this initiated sinking or pre-sinking step, the first module and the second longitudinal support are sunk to the same reduced depth.

Advantageously, the second longitudinal support comprises a second receiving part extending along the third longitudinal direction, and:

at least a second module is provided comprising a longitudinal element extending along a fourth longitudinal direction and at least a first wing protruding from a first lateral edge of said longitudinal element, the first wing extending along the fourth longitudinal direction of the longitudinal element of the second module;

the second module is positioned parallel to the second longitudinal support;

the second module is connected to the first portion of the second longitudinal support, so that the first wing of the second module is slidably engaged along the third longitudinal direction with the second receiving part of the second longitudinal support;

said second module is moved in translation parallel to the second longitudinal support along the third longitudinal direction, and said second module is sunk into the ground.

The second longitudinal support makes it possible to connect the first module and the second module together.

In a non-limiting manner, the retaining wall can comprise a plurality, preferably several tens, of longitudinal supports and modules. The retaining wall is formed of an alternation of longitudinal supports and modules.

Preferably, said second longitudinal support is sunk into the ground after having sunk all of the modules into the ground. Still preferably, the longitudinal supports are sunk into the ground after having sunk the modules into the ground.

Preferably, the second longitudinal support is sunk into the ground after having sunk the first longitudinal support into the ground.

According to a second advantageous embodiment, said first module comprises a single wing. In this non-limiting embodiment, the first longitudinal support is preferably provided with a wing and more preferably, the first longitudinal support is substantially similar to the first module.

Preferably, the longitudinal element of the first module comprises a receiving part extending along the second longitudinal direction, and:

at least a second module is provided comprising a longitudinal element extending along a third longitudinal direction and at least a first wing protruding from a first lateral edge of said longitudinal element, the first wing extending along the third longitudinal direction of the longitudinal element of the second module;

before moving said first module in translation parallel to the first longitudinal support, the second module is positioned parallel to the first module;

the second module is connected to the first module, so that the first wing of the second module is slidably engaged along the second longitudinal direction with the receiving part of the first module;

said second module is moved in translation parallel to the first module along the second longitudinal direction, and said second module is sunk into the ground.

In this non-limiting embodiment, the retaining wall consists of a plurality of modules connected to each other. The retaining wall is then devoid of longitudinal supports extending between two consecutive modules.

Advantageously, a guide structure is provided comprising at least one guide orifice configured to receive said first module, said guide structure is positioned above the ground, facing an area of installation of the retaining wall, and said first module is engaged in the first guide orifice before being positioned parallel to the first longitudinal support, in order to guide the displacement of said first module parallel to the first longitudinal support. One consideration is to position the first module all the more precisely, in particular with respect to the first longitudinal support, and to facilitate its connection with the first longitudinal support. One advantage is further to guarantee a better alignment of the longitudinal supports and modules of the retaining wall.

Preferably, the guide structure comprises a plurality of guide orifices, each being configured to receive one of the modules or one of the longitudinal supports of the retaining wall. Each of said modules, respectively each of the longitudinal supports, is then engaged with one of the guide orifices before being positioned parallel to the longitudinal supports, respectively parallel to the modules, in order to guide the displacement of said modules, respectively of said longitudinal supports.

In a non-limiting manner, the guide structure can be removed when the sinking of all the longitudinal supports and modules has been initiated and therefore when these are fixed in the ground, or when the sinking of all the longitudinal supports and modules of a curtain has been initiated.

Preferably, the method comprises a prior step of fixing at least one bearing means to the ground configured to support said guide structure, and positioning said guide structure so that it bears on said bearing means. The bearing means advantageously comprises a pile or a section. In a non-limiting manner, said bearing means can be extracted from the ground and removed after the fabrication of the retaining wall.

The present disclosure also relates to a module for implementing the method described above, the module comprising a longitudinal element extending along a longitudinal direction and at least a first wing protruding from a first lateral edge of said longitudinal element, the first wing extending along the longitudinal direction of the longitudinal element.

Advantageously, the longitudinal element comprises a first assembly part extending along the first lateral edge of said longitudinal element and the first wing comprises a second assembly part configured to cooperate with the first assembly part in order to allow the assembly of the first wing and of the longitudinal element. The first assembly part advantageously comprises a first latch part and the second assembly part advantageously comprises a second latch part configured to cooperate with the first latch part.

Advantageously, the longitudinal element is provided with at least one wedge configured to block the translation of said first wing relative to the longitudinal element, along said second longitudinal direction. One consideration is to overcome welds to assemble the first wing and the longitudinal element, which makes it possible to retain a degree of freedom making it possible to correct any clearance between said first wing and said longitudinal element during the set up of the first module.

The present disclosure also relates to a retaining wall configured to extend into a ground and comprising at least a first module as described above, and at least a first longitudinal support extending along a first longitudinal direction and having a receiving part extending along the first longitudinal direction, the first longitudinal support being configured to be placed transversely to the ground, so that the first longitudinal support comprises at least a first portion extending out of the ground, the first module being configured to be connected to the first portion of the first longitudinal support, so that the first wing of the first module is slidably engaged along the first longitudinal direction with the receiving part of the first longitudinal support.

BRIEF DESCRIPTION OF THE DRAWINGS

The present disclosure will be better understood upon reading the following description of embodiments of the present disclosure given by way of non-limiting examples, with reference to the appended drawings, in which:

FIG. 1 illustrates a step of the method according to the present disclosure in which bearing means are installed;

FIG. 2 illustrates a step of the method according to the present disclosure in which a guide structure is installed;

FIG. 3 illustrates a longitudinal support and a first embodiment of a module according to the present disclosure;

FIG. 4 illustrates the module of FIG. 3 in top view;

FIG. 5 illustrates a step of setting up a first longitudinal support of the method according to the present disclosure;

FIG. 6 illustrates a step of installing a mast;

FIG. 7 illustrates a step for setting up a first module of the method according to the present disclosure;

FIG. 8 illustrates, in top view, the connection between the first module and the first longitudinal support of FIG. 7;

FIG. 9 illustrates a step for setting up a second longitudinal support of the method according to the present disclosure;

FIG. 10 illustrates the modules and the longitudinal supports of the retaining wall pre-sunk into the ground;

FIG. 11 illustrates a step of the method according to the present disclosure in which the modules are sunk into the ground;

FIG. 12 illustrates the step of FIG. 11 in perspective view;

FIG. 13 illustrates a step of the method according to the present disclosure in which the longitudinal supports are sunk into the ground;

FIG. 14 illustrates a retaining wall fabricated in the ground by means of the method according to the present disclosure;

FIG. 15 illustrates an intermediate step of one variant for setting up the modules and the longitudinal supports;

FIG. 16 illustrates the longitudinal supports and the modules set up according to the variant of the method shown in FIG. 15; and FIG. 17 illustrates a second embodiment of a module according to the present disclosure.

DETAILED DESCRIPTION

The present disclosure relates to a method for fabricating a retaining wall configured to extend into a ground. This method makes it possible in particular to fabricate a retaining wall in port areas, for example quay, lock, bank reinforcement and quay deepening walls. The present disclosure also relates to a module for implementing the method and to a retaining wall comprising such a module.

A first non-limiting embodiment of the method, in accordance with the present disclosure, for fabricating a retaining wall W configured to extend into a ground S, will be described. In this non-limiting example, the ground is a seabed.

First of all, a driving machine 10 configured to install the different elements making up the retaining wall W is provided. The driving machine 10 comprises a frame 12 and an arm 14 carrying a hoist 16 equipped with a rope 18 and a hammer 19. The driving machine is disposed on a bank above the level of the seabed S. The hammer 19 is able to exert a force of percussion or to put a tube in vibration.

According to a first non-limiting step, illustrated in FIG. 1, a first bearing means 20 and a second bearing means 21 are positioned transversely to the ground S and substantially vertically. Said bearing means are slightly sunk into the ground, to a reduced depth, so as to be fixed to said ground, at a distance from each other. In this non-limiting example, the bearing means 20, 21 are identical and each comprise a pile.

In a non-limiting manner, according to a second step illustrated in FIG. 2, a guide structure 22 is positioned above the ground S and more specifically above an area Z of installation of the retaining wall. The guide structure is put in abutment on the bearing means 20, 21, which make it possible to maintain it above the ground. The guiding structure 22 has the shape of a cage. It is provided with a plurality of guide orifices 23 passing through said cage vertically and extending substantially transversely to the ground when said guide structure 22 is placed in abutment on the bearing means 21, 22.

A first longitudinal support 24 is then provided, illustrated in FIG. 3. The first longitudinal support 24 extends along a first longitudinal direction L1 and consists in this non-limiting example of a tubular metal pile. It further comprises a first receiving part 26 and a second receiving part 28 disposed on either side of the first longitudinal support 24 and each extending along the first longitudinal direction L1. In a non-limiting manner, the first longitudinal support 24 could comprise only one receiving part.

The first longitudinal support 24 is seized using the rope 18 of the machine 10 and the first longitudinal support 24 is first engaged in a first guide orifice 23 of the guide structure 22. As illustrated in FIG. 5, the first longitudinal support 24 is then moved downwards, towards the ground, so as to be positioned transversely to the ground S, while being guided by the guide structure 22.

In this non-limiting example, the first longitudinal support 24 is placed perpendicular to the ground S and is installed in the ground, so that it has a first portion 24*a* extending out of the ground and a second portion 24*b* extending into the ground. The first longitudinal support 24 is slightly sunk or even pre-sunk into the ground, so that the length of the first portion 24*a* is much greater than the length of the second portion 24*b* of the first longitudinal support. The verticality and positioning of the first longitudinal support are rigorously checked. The first longitudinal support is sunk into the ground by driving, by percussion of the hammer 19 on said longitudinal support.

A first prefabricated module 30 is then provided, a first embodiment of which is illustrated in FIG. 3. In this first embodiment, the first module 30 comprises a longitudinal element 32 extending along a second longitudinal direction L2 as well as a first wing 34 and a second wing 36. In this non-limiting example, the first longitudinal element 32 consists of a metal pile similar to the first longitudinal support 24. The first and second wings 34, 36 are metal sheet piles in the form of corrugated sheets. The first wing 34 protrudes from a first lateral edge 31 of the longitudinal element 32 and extends radially with respect to said longitudinal element. The second wing 36 protrudes from a second lateral edge 33 of the longitudinal element, opposite to the first lateral edge 31, and extends radially with respect to said longitudinal element.

As can be seen in FIG. 4, illustrating the first module in top view, the first lateral edge 31 of the longitudinal element 32 comprises in particular a first assembly part 35, consisting in this non-limiting example of a first hook-shaped latch portion extending along the second longitudinal direction L2. The first wing 34 comprises a first border provided with a second assembly part 37, consisting in this non-limiting example of a second hook-shaped latch portion, configured to cooperate with the first assembly part 35. The first module 30 is assembled off the ground, in a step prior to the fabrication of the retaining wall, and therefore before said first module is sunk or pre-sunk into the ground. To do so, the second assembly part 37 of the first wing 34 is brought into cooperation with the first assembly part 35 to secure the first wing to the longitudinal element 32. Similarly, the second wing 36 is connected to the second lateral edge 33 of the longitudinal element. The first and second wings 34, 36 extend in the extension of each other.

Referring again to FIG. 3, it is seen that the first module 30 further comprises four blocking members 39. Two blocking members are mounted on either side of the longitudinal element 32, for example by welding, and extend respectively under the first wing 34 and under the second wing 36. Two other blocking members 39 are mounted on either side of the longitudinal element 32, and extend respectively above the first wing 34 and above the second wing 36. These blocking members are configured to block the sliding of said wings relative to the longitudinal element, along the second longitudinal direction L2.

In this embodiment, and as can be seen in FIG. 6, a mast 46 is then installed in the ground so that an anchoring portion 47 of the mast 46 extends into the ground, at a depth greater than the depth at which the first longitudinal support 24 is pre-sunk. A supporting portion 48 of the mast extends out of the ground and passes through the first longitudinal support 24. The mast 46 is disposed in a housing 29 of the first longitudinal support and allows improving its resistance and holding it more effectively in the pre-sunk position. In a non-limiting manner, the mast could be installed before setting up the first longitudinal support 24, in which case the first longitudinal support would be fitted onto said mast 46.

As illustrated in FIG. 7, the first module 30 is then seized using the rope 18 of the machine 10 and the first module 30 is first engaged in a second guide orifice 23 of the guide structure 22. The first module 30 is then moved downwards, towards the ground, and is positioned parallel to the first longitudinal support 24. In a non-limiting manner, the sinking of the longitudinal element 32 of said first module 30 into the ground is jointly initiated, by means of the hammer 19, by driving. In other words, the longitudinal element 32 of the first module 30 is sunk into the ground to a reduced depth, so as to fix the first module 30 to the ground. In a non-limiting manner, the first module is then pre-sunk into the ground, to the same depth as the first longitudinal support 24.

The first module 30 is further connected to the first portion 24*a* of the first longitudinal support 24, as illustrated in top view, in FIG. 8. In this non-limiting example, the first receiving part 26 of the first longitudinal support 24 comprises a first hook-shaped latch portion 25 extending along the first longitudinal direction L1. The first wing 34 of said first module 30 comprises a second border provided with a second hook-shaped latch portion 27 extending along the second longitudinal direction L2.

The second latch portion 27 is brought into cooperation with the first latch portion 25 in order to engage the first wing 34 of the first module 30 in a sliding manner with said receiving part 26 of the first longitudinal support 24, along the first longitudinal direction L1.

The steps of positioning the first module 30 parallel to the first longitudinal support 24 and of connecting the first module 30 to the first portion 24*a* of the first longitudinal support can be simultaneous or successive.

A second longitudinal support 40 extending along a third longitudinal direction L3 is then provided. This second longitudinal support 40 is substantially identical to the first longitudinal support 24 and to the longitudinal element 32 of the first module 30, illustrated in FIG. 3. It also comprises a first receiving part 42 and a second receiving part 44 extending along the third longitudinal direction L3.

As illustrated in FIG. 9, after having engaged the second longitudinal support 40 in a third guide orifice 23 of the guide structure 22, the second longitudinal support 40 is placed transversely to the ground S, parallel to the first module 30 and to the first longitudinal support 24. The first, second and third longitudinal directions L1, L2, L3 are then parallel to each other. In this non-limiting example, the second longitudinal support 40 is placed perpendicular to the ground S and is installed in the ground, by driving, so that it has a first portion 40*a* extending out of the ground and a second portion 40*b* extending into the ground. The second longitudinal support is slightly sunk or even pre-sunk into the ground, so that the length of the first portion 40*a* is much greater than the length of the second portion 40*b* of the first longitudinal support. The second longitudinal support 40 is sunk to the same reduced depth as the first longitudinal support 24 and the first module 30.

The first module 30 is then connected to the first portion of the second longitudinal support 40. To do so, the second wing 36 of the first module comprises a second border provided with a first latch portion, and the second receiving part of the second longitudinal support 40 comprises a second latch portion. Said first and second latch portions are brought into cooperation, so that the second wing 36 of the first module 30 is slidably engaged along the third longitudinal direction L3 with the first receiving part 42 of the second longitudinal support 40.

A second prefabricated module 50 is then provided, visible in FIG. 10, identical to the first module 30, and comprising in particular a longitudinal element 52 and a first wing 54. The second module 50 is connected to the first portion 40*a* of the second longitudinal support 40. To do so, the first wing 54 of the second module 50 is slidably engaged along the third longitudinal direction L3 with the second receiving part 44 of the second longitudinal support 40.

The steps detailed previously are repeated so as to connect together a succession of modules and longitudinal supports, so as to form a first curtain as illustrated in FIG. 10. The guide structure can be moved and the steps described previously can be repeated in order to position a larger number of modules and longitudinal supports and thus form a plurality of successive curtains.

In this non-limiting embodiment, the sinking of the longitudinal modules and supports is initiated and these are pre-sunk to a reduced depth. As a variant, said longitudinal supports and said modules could be maintained out of the ground when they are set up transversely relative to the ground S, and be maintained above the ground or laid on the ground, as illustrated in the variant of FIGS. 15 and 16. The guide structure 22 then makes it possible to hold the longitudinal supports and the modules in position, transversely to the ground. Furthermore, in this variant, the mast 46 makes it possible to hold the first longitudinal support 24 in position, without it being necessary to install it in the ground. In this variant, the method is devoid of a step of initiating the sinking or of pre-sinking said longitudinal supports and said modules.

Referring again to FIGS. 10 and 11, in a non-limiting manner, the guide structure 22 and the bearing means 20, 21 are removed. The first module 30 is then moved in translation parallel to the first longitudinal support 24 along the first longitudinal direction L1, and said first module is sunk into the ground S. The first and second longitudinal supports 24, 40 guide the displacement of said first module 30. All the modules are also sunk into the ground. The modules are sunk into the ground by driving, using the hammer 19. In the sunk position, the modules extend substantially entirely into the ground, to a depth much greater than the reduced depth to which they were pre-sunk previously. The wings of the modules extend substantially entirely into the ground.

FIG. 12 illustrates the steps of FIG. 11 in perspective view. In this view, it is seen that the driving machine 10 is disposed on the quay and overhangs the area of installation Z of the retaining wall.

As illustrated in FIG. 13, all of the longitudinal supports are then moved and sunk into the ground by driving, using the hammer 19. The supports are moved in translation along the modules to which they are connected, along a substantially vertical direction and parallel to said modules. In a non-limiting manner, the first longitudinal support 24 could be sunk last. As a variant, the last longitudinal support set up, corresponding to the right longitudinal support in FIG. 13, could be left in the pre-sunk position, in order to form a first longitudinal support for an additional curtain which would be installed following the first curtain illustrated in this figure.

In a non-limiting manner, the mast 46 could be left in the ground, such that it guides the displacement and the sinking of the first longitudinal support 24 into the ground.

FIG. 14 illustrates a retaining wall W, formed of a single curtain, and fabricated in the ground by implementing the method according to the present disclosure.

FIGS. 15 and 16 illustrate two successive steps of a variant of the method according to the present disclosure in which the longitudinal supports and the modules are laid on the ground before being moved and sunk into the ground.

FIG. 17 illustrates a second embodiment of a module according to the present disclosure. In this embodiment, the module 30' comprises a longitudinal element 32' extending along a longitudinal direction and a single wing 34' protruding from a first lateral edge 31' of the longitudinal element. The longitudinal element further comprises a receiving part 33' extending along the longitudinal direction of the longitudinal element. The wing 34' is configured to be connected to the receiving part of a longitudinal support or to the receiving portion of another module 30'.

In this second embodiment, each module 30' is configured to be connected directly to another module 30'. Particularly, the wing 34' of a second module is configured to be connected to the receiving part 33' of a first module. In this embodiment, the retaining wall is devoid of longitudinal supports extending between the modules. Furthermore, in this second embodiment, the first longitudinal support is constituted by a module 30'.

The invention claimed is:

1. A method for fabricating a retaining wall configured to extend into a ground, the method comprising the following steps:

providing at least a first longitudinal support extending along a first longitudinal direction, the first longitudinal support having a receiving part extending along the first longitudinal direction;

placing the first longitudinal support transversely to the ground, so that the first longitudinal support comprises at least a first portion extending out of the ground;

providing at least a first module comprising a longitudinal element extending along a second longitudinal direction and at least a first wing protruding from a first lateral edge of said longitudinal element, the longitudinal element comprising a pile, the first wing extending along the second longitudinal direction of the longitudinal element;

positioning the first module parallel to the first longitudinal support;

connecting the first module to the first portion of the first longitudinal support, so that the first wing of the first module is slidably engaged along the first longitudinal direction with the receiving part of the first longitudinal support; then moving said first module in translation parallel to the first longitudinal support along the first longitudinal direction, and sinking said first module into the ground; then sinking the first portion of the first longitudinal support into the ground so as to form the retaining wall in the ground.

2. The method according to claim 1, wherein the longitudinal element of the first module comprises a first assembly part extending along the first lateral edge of said longitudinal element, wherein the first wing of the first module comprises a second assembly part configured to cooperate with the first assembly part, the method comprising a prior step of assembling off ground said longitudinal element with said first wing, so that the first assembly part cooperates with the second assembly part.

3. The method according to claim 1, wherein the first longitudinal support comprises a pile, a section or a metal box.

4. The method according to claim 1, wherein said first wing of said first module comprises a sheet pile.

5. The method according to claim 1, wherein the first longitudinal support comprises a housing, and wherein, before or after having placed the first longitudinal support transversely to the ground (S), a mast is installed in the ground so that an anchoring portion of the mast extends into the ground, the mast further comprising a supporting portion configured to be disposed in said housing of the first longitudinal support.

6. The method according to claim 5, wherein, during the step of setting up the first longitudinal support transversely to the ground, said first longitudinal support is laid on the ground, so that it extends out of the ground and so that the supporting portion of the mast extends in said housing of the first longitudinal support, and wherein, during the step of positioning of the first module parallel to the first longitudinal support, said first module is laid on the ground, so that it extends out of the ground.

7. The method according to claim 1, wherein, during the step of setting up the first longitudinal support transversely to the ground, said first longitudinal support is installed in the ground, so that a second portion of the first longitudinal support extends into the ground.

8. The method according to claim 7, wherein, during the step of positioning the first module parallel to the first longitudinal support, the sinking of the longitudinal element of said first module into the ground is initiated.

9. The method according to claim 1, wherein the receiving part of the first longitudinal support comprises a first latch portion extending along the first longitudinal direction and wherein said first wing of said first module comprises a second latch portion extending along the second longitudinal direction and being configured to cooperate with the first latch portion in order to engage the first wing of the first module in a sliding manner with said receiving part of the first longitudinal support.

10. The method according to claim 1, wherein said first module further comprises at least a second wing protruding from a second lateral edge of said longitudinal element, opposite to the first lateral edge, the second wing extending along the second longitudinal direction of the longitudinal element of the first module, so that said first and second wings of said first module extend on either side of said longitudinal element.

11. The method according to claim 10, wherein, before moving said first module in translation parallel to the first longitudinal support, the steps are carried out according to which:

at least a second longitudinal support extending along a third longitudinal direction is provided, the second longitudinal support having a first receiving part extending along the third longitudinal direction;

the second longitudinal support is placed transversely to the ground, parallel to the first module, so that the second longitudinal support comprises at least a first portion extending out of the ground;

the first module is connected to the first portion of the second longitudinal support, so that the second wing of the first module is slidably engaged along the third longitudinal direction with the first receiving part of the second longitudinal support.

12. The method according to claim 11, wherein the first longitudinal support comprises a housing, wherein, before or after having placed the first longitudinal support transversely to the ground (S), a mast is installed in the ground so that an anchoring portion of the mast extends into the ground, the mast further comprising a supporting portion configured to be disposed in said housing of the first longitude support, wherein, during the step of setting up the first longitudinal support transversely to the ground, said first longitudinal support is laid on the ground, so that it extends out of the ground and so that the supporting portion of the mast extends in said housing of the first longitudinal support, wherein, during the step of positioning of the first module parallel to the first longitudinal support, said first module is laid on the ground, so that it extends out of the ground, and wherein, after having connected the first module to the first portion of the second longitudinal support, the sinking of the longitudinal element of said first module into the ground is initiated, then the sinking of said second longitudinal support into the ground is initiated.

13. The method according to claim 12, wherein said second longitudinal support is sunk into the ground after having sunk all the modules into the ground.

14. The method according to claim 11, wherein the second longitudinal support comprises a second receiving part extending along the third longitudinal direction and wherein:

at least a second module is provided comprising a longitudinal element extending along a fourth longitudinal direction and at least a first wing protruding from a first lateral edge of said longitudinal element, the first wing extending along the fourth longitudinal direction of the longitudinal element of the second module;

the second module is positioned parallel to the second longitudinal support;

the second module is connected to the first portion of the second longitudinal support, so that the first wing of the second module is slidably engaged along the third longitudinal direction with the second receiving part of the second longitudinal support;

said second module is moved in translation parallel to the second longitudinal support along the third longitudinal direction, and said second module is sunk into the ground.

15. The method according to claim 1, wherein said first module comprises a single wing.

16. The method according to claim 15, wherein the longitudinal element of the first module comprises a receiving part extending along the second longitudinal direction, and wherein:

at least a second module is provided comprising a longitudinal element extending along a third longitudinal direction and at least a first wing protruding from a first lateral edge of said longitudinal element, the first wing extending along the third longitudinal direction of the longitudinal element of the second module;

before moving said first module in translation parallel to the first longitudinal support, the second module is positioned parallel to the first module;

the second module is connected to the first module, so that the first wing of the second module is slidably engaged along the second longitudinal direction with the receiving part of the first module;

said second module is moved in translation parallel to the first module along the second longitudinal direction, and said second module is sunk into the ground.

17. The method according to claim 1, wherein a guide structure is provided comprising at least a first guide orifice configured to receive said first module, wherein said guide structure is positioned above the ground, facing an area of installation of the retaining wall, and wherein said first module is engaged in the first guide orifice before being positioned parallel to the first longitudinal support, in order to guide the displacement of said first module parallel to the first longitudinal support.

18. A module for implementing the method according to claim 1, said module comprising a longitudinal element extending along a longitudinal direction and at least a first wing protruding from a first lateral edge of said longitudinal element, the first wing extending along the longitudinal direction of the longitudinal element, wherein the longitudinal element comprises a first assembly part extending along the first lateral edge of said longitudinal element and wherein the first wing comprises a second assembly part configured to cooperate with the first assembly part in order to allow the assembly of the first wing and of the longitudinal element, said longitudinal element provided with at least one blocking member configured to block the translation of said first wing relative to the longitudinal element, along said second longitudinal direction.

19. A retaining wall configured to extend into a ground and comprising at least a first module according to claim 18, and at least a first longitudinal support extending along a first longitudinal direction and having a receiving part extending along the first longitudinal direction, the first longitudinal support being configured to be placed transversely to the ground, so that the first longitudinal support comprises at least a first portion extending out of the ground, the first module being configured to be connected to the first portion of the first longitudinal support, so that the first wing of the first module is slidably engaged along the first longitudinal direction with the receiving part of the first longitudinal support.

20. A method for fabricating a retaining wall configured to extend into a ground, the method comprising the following steps:

providing at least a first longitudinal support extending along a first longitudinal direction, the first longitudinal support having a receiving part extending along the first longitudinal direction;

placing the first longitudinal support transversely to the ground, so that the first longitudinal support comprises at least a first portion extending out of the ground;

providing at least a first module comprising a pile extending along a second longitudinal direction and having a first assembly part extending along a first lateral edge of said pile, the at least a first module further comprising at least a first wing protruding from the first lateral edge of said pile, the first wing extending along the second longitudinal direction of the pile, the first wing comprising a second assembly part configured to cooperate with the first assembly part;

as a prior step, assembling off ground said pile with said first wing, so that the first assembly part cooperates with the second assembly part;

positioning the first module parallel to the first longitudinal support;

connecting the first module to the first portion of the first longitudinal support, so that the first wing of the first module is slidably engaged along the first longitudinal direction with the receiving part of the first longitudinal support; then moving said first module in translation parallel to the first longitudinal support along the first longitudinal direction, and sinking said first module into the ground; then sinking the first portion of the first longitudinal support into the ground so as to form the retaining wall in the ground.

21. A method for fabricating a retaining wall configured to extend into a ground, the method comprising the following steps:

providing at least a first longitudinal support extending along a first longitudinal direction, the first longitudinal support comprising a housing and having a receiving part extending along the first longitudinal direction;

placing the first longitudinal support transversely to the ground while laying said first longitudinal support on the ground, so that it extends out of the ground;

before or after having placed the first longitudinal support transversely to the ground (S), installing a mast in the ground so that an anchoring portion of the mast extends into the ground, the mast further comprising a supporting portion configured to be disposed in said housing of the first longitudinal support, said first longitudinal support being laid on the ground so that the supporting portion of the mast extends in said housing of the first longitudinal support;

providing at least a first module comprising a longitudinal element extending along a second longitudinal direction and at least a first wing protruding from a first lateral edge of said longitudinal element, the first wing extending along the second longitudinal direction of the longitudinal element;

positioning the first module parallel to the first longitudinal support said while laying the first module on the ground, so that it extends out of the ground;

connecting the first module to the first portion of the first longitudinal support, so that the first wing of the first module is slidably engaged along the first longitudinal direction with the receiving part of the first longitudinal support; then moving said first module in translation parallel to the first longitudinal support along the first longitudinal direction, and sinking said first module into the ground; then sinking the first portion of the first longitudinal support into the ground so as to form the retaining wall in the ground.

* * * * *